US010945919B2

(12) United States Patent
Obrad et al.

(10) Patent No.: US 10,945,919 B2
(45) Date of Patent: Mar. 16, 2021

(54) CRYOCASSETTE

(71) Applicant: Cryoport, Inc., Brentwood, TN (US)

(72) Inventors: Frank Obrad, Fullerton, CA (US); Tim Bell, Irvine, CA (US); Jim Sunabe, Fullerton, CA (US)

(73) Assignee: Cryoport, Inc., Brentwood, TN (US)

( * ) Notice: Subject to any disclaimer, the term of this patent is extended or adjusted under 35 U.S.C. 154(b) by 596 days.

(21) Appl. No.: 15/841,170

(22) Filed: Dec. 13, 2017

(65) Prior Publication Data

US 2019/0175448 A1 Jun. 13, 2019

(51) Int. Cl.

| | |
|---|---|
| ***B65D 75/14*** | (2006.01) |
| ***A61J 1/16*** | (2006.01) |
| ***B65D 81/07*** | (2006.01) |
| ***A61J 1/14*** | (2006.01) |
| ***B65D 81/03*** | (2006.01) |
| *A61J 1/10* | (2006.01) |

(52) U.S. Cl.

CPC ..... *A61J 1/1468* (2015.05); *A61J 1/16* (2013.01); *A61J 1/165* (2013.01); *B65D 75/14* (2013.01); *B65D 81/03* (2013.01); *B65D 81/07* (2013.01); *A61J 1/10* (2013.01)

(58) Field of Classification Search

CPC .. A61J 1/1468; A61J 1/16; A61J 1/165; A61J 1/10; B65D 75/14; B65D 81/03; B65D 81/07

See application file for complete search history.

(56) References Cited

U.S. PATENT DOCUMENTS

| | | | |
|---|---|---|---|
| 3,717,005 | A | 2/1973 | McGrew et al. |
| 3,948,409 | A | 4/1976 | Ovchinnikov et al. |
| 4,306,425 | A | 12/1981 | Sitte et al. |
| 4,411,138 | A | 10/1983 | Leithauser et al. |
| 4,455,842 | A | 6/1984 | Granlund |
| 4,694,655 | A | 9/1987 | Seidel et al. |
| 4,729,494 | A | 3/1988 | Peillon et al. |

(Continued)

FOREIGN PATENT DOCUMENTS

| | | |
|---|---|---|
| JP | 3958213 | 5/2018 |
| WO | 2002053967 | 11/2002 |

OTHER PUBLICATIONS

USPTO; Non-Final Office Action dated Dec. 2, 2011 in U.S. Appl. No. 12/658,641.

(Continued)

*Primary Examiner* — Tatyana Zalukaeva
*Assistant Examiner* — Jessica A Arble
(74) *Attorney, Agent, or Firm* — Snell & Wilmer L.L.P.

(57) ABSTRACT

Methods, apparatus, and device, such as a blood bag envelope, that protects a blood bag during storage and/or transport. The blood bag envelope holds a blood bag or a metal cassette that contains the blood bag. The envelope includes multiple panels. The multiple panels include a top panel, a first edge panel, a second edge panel, a front panel and a bottom panel. The multiple panels are configured to fold to form the enclosure to hold the blood bag. The envelope includes a first fastening device connected to an inner surface of the top panel. The envelope includes a suspension device that is suspended from the first fastening device. The suspension device is configured to suspend the blood bag within the enclosure when the multiple panels are folded to form the enclosure.

20 Claims, 12 Drawing Sheets

(56) References Cited

U.S. PATENT DOCUMENTS

| | | | | |
|---|---|---|---|---|
| 4,790,141 | A | 12/1988 | Glascock | |
| 5,954,202 | A * | 9/1999 | Mellon | B65D 75/14 206/462 |
| 6,206,194 | B1 * | 3/2001 | Beneroff | B65D 5/5028 206/583 |
| 6,467,642 | B2 | 10/2002 | Mullens et al. | |
| 6,539,360 | B1 | 3/2003 | Kadaba | |
| 7,627,926 | B2 | 12/2009 | Williams | |
| 7,881,987 | B1 | 2/2011 | Hart | |
| 8,220,107 | B2 | 7/2012 | Williams | |
| 8,371,449 | B2 * | 2/2013 | Berry | B65D 5/4802 206/583 |
| 8,397,343 | B2 | 3/2013 | Williams | |
| 9,292,824 | B1 | 3/2016 | Freeman | |
| 9,378,442 | B2 | 6/2016 | Barnings | |
| 2002/0099567 | A1 | 7/2002 | Joao | |
| 2002/0102992 | A1 | 8/2002 | Koorapaty | |
| 2002/0167500 | A1 | 11/2002 | Gelbman | |
| 2003/0137968 | A1 | 7/2003 | Lareau et al. | |
| 2004/0215532 | A1 | 10/2004 | Boman | |
| 2004/0236635 | A1 | 11/2004 | Publicover | |
| 2005/0046584 | A1 | 3/2005 | Breed | |
| 2005/0171738 | A1 | 8/2005 | Kadaba | |
| 2005/0234785 | A1 | 10/2005 | Burman | |
| 2005/0246192 | A1 | 11/2005 | Jauffred et al. | |
| 2006/0080819 | A1 | 4/2006 | McAllister | |
| 2006/0168644 | A1 | 7/2006 | Richter et al. | |
| 2007/0009119 | A1 | 1/2007 | Pohle et al. | |
| 2007/0028642 | A1 | 2/2007 | Glade et al. | |
| 2007/0095722 | A1 | 5/2007 | Messinger | |
| 2007/0268138 | A1 | 11/2007 | Chung et al. | |
| 2008/0094209 | A1 | 4/2008 | Braun | |
| 2008/0162304 | A1 | 7/2008 | Ourega | |
| 2008/0291033 | A1 | 11/2008 | Aghassipour | |
| 2009/0014537 | A1 | 1/2009 | Gelbman | |
| 2009/0293524 | A1 | 12/2009 | Vezina et al. | |
| 2009/0314835 | A1 | 12/2009 | Jackson | |
| 2010/0080168 | A1 | 4/2010 | Fukuyama | |
| 2010/0204558 | A1 | 8/2010 | Zocchi | |
| 2010/0299278 | A1 | 11/2010 | Kriss et al. | |
| 2011/0031304 | A1 | 2/2011 | Phillips | |
| 2011/0176749 | A1 | 7/2011 | Race | |
| 2011/0216178 | A1 | 9/2011 | Carpenter | |
| 2014/0144800 | A1 * | 5/2014 | Delorme | A61B 5/150038 206/438 |
| 2014/0319022 | A1 | 10/2014 | Chu | |

OTHER PUBLICATIONS

USPTO; Final Office Action dated Aug. 14, 2012 in U.S. Appl. No. 12/658,641.
USPTO; Non-Final Office Action dated Sep. 11, 2015 in U.S. Appl. No. 12/658,641.
USPTO; Non-Final Office Action dated Dec. 11, 2012 in U.S. Appl. No. 12/852,413.
USPTO; Final Office Action dated May 7, 2012 in U.S. Appl. No. 12/852,413.
USPTO; Advisory Action dated Jul. 31, 2012 in U.S. Appl. No. 12/852,413.
USPTO; Non-Final Office Action dated Jun. 18, 2014 in U.S. Appl. No. 12/852,413.
USPTO; Non-Final Office Action dated Jun. 17, 2016 in U.S. Appl. No. 12/852,413.
USPTO; Final Office Action dated Nov. 29, 2016 in U.S. Appl. No. 12/852,413.
USPTO; Non-Final Office Action dated Jul. 25, 2017 in U.S. Appl. No. 14/589,768.
USPTO; Final Office Action dated Feb. 7, 2018 in U.S. Appl. No. 14/589,768.
USPTO; Non-Final Office Action dated Jun. 19, 2018 in U.S. Appl. No. 14/589,768.
USPTO; Final Office Action dated Dec. 27, 2018 in U.S. Appl. No. 14/589,768.
PCT; International Search Report dated May 31, 2002 in International Application No. PCT/US2001/049684.
PCT; International Search Report dated Jun. 28, 2010 in International Application No. PCT/US2010/023252.
PCT; Written Opinion of International Search Authority dated Jun. 28, 2010 in International Application No. PCT/US2010/023252.
PCT; International Preliminary Report on Patentability dated Mar. 22, 2013 in International Application No. PCT/US2010/023252.
Electronic Reusable Paper, http://www2.parc.com/hsl/projects/gyricon/, (Oct. 2005).
PCT; International Search Report & Written Opinion dated Apr. 24, 2019 in PCT Application No. US2018/065509.
PCT; International Preliminary Report on Patentability dated Jun. 16, 2020 in PCT Application No. US2018/065509.

* cited by examiner

CRYOCASSETTE

BACKGROUND

1. Field

This specification relates to a system, device or apparatus for cryogenically storing, transporting and/or shipping a liquid, such as blood, under cryogenic temperatures.

2. Description of the Related Art

Medical practitioners or professions may refrigerate or freeze blood for storage and/or transportation to a medical facility. When transporting blood, the blood may be refrigerated and stored in a blood bag. Less-dense blood plasma is often frozen at cryogenic temperatures. At cryogenic temperatures, the blood bags may shatter during transport because the storage devices that store the blood bags are brittle at cryogenic temperatures. Blood bag manufacturers may provide an overwrap bag that is made of material that is more cryogenically friendly, i.e., less brittle, and does not shatter at cryogenic temperatures. The overwrap bag is placed over the blood bag and contains the blood within the blood bag if the blood bag shatters. The overwrap bag, however, does not prevent the blood bag from shattering and does not maintain the integrity and usability of the blood that has been released.

Often, the blood bag is placed into a metallic case for transport. The metallic case holds the blood bag while in storage and during transportation. The metallic case holds the shape of the blood bag and protects the blood bag from external damage, such as cuts and punctures. The metal case, however, does not protect the blood bag from shocks and vibrations. Any impact to the metallic case also causes the blood bag to slide and impact the inner surfaces of the case which may cause the blood bag to shatter.

Accordingly, there is a need for a system, device or apparatus to protect a blood bag from shocks and vibration during storage and transfer.

SUMMARY

In general, one aspect of the subject matter described in this specification is embodied in a blood bag envelope. The blood bag envelope holds a blood bag or a metal cassette that contains the blood bag. The envelope includes multiple panels. The multiple panels include a top panel, a first edge panel, a second edge panel, a front panel and a bottom panel. The multiple panels are configured to fold to form the enclosure that surrounds the blood bag. The envelope includes a first fastening device connected to an inner surface of the top panel. The envelope includes a suspension device that is suspended from the first fastening device. The suspension device is configured to suspend the blood bag within the enclosure when the multiple panels are folded to form the enclosure.

These and other embodiments may optionally include one or more of the following features. The envelope may include a second fastening device. The second fastening device may be connected to an inner surface of the first edge panel. The suspension device may be suspended from the first fastening device and the second fastening device. The first fastening device may be inserted into a slot in the top panel to suspend the blood bag within the enclosure formed from the multiple panels when folded. The second fastening device may be inserted into a slot in the first edge panel to suspend the blood bag within the enclosure formed from the multiple panels when folded. The suspension device may be made from a polymer material.

The top panel may have a leading edge, a trailing edge, a first side edge and a second side edge. The first edge panel may be connected to the first side edge of the top panel and may have one or more first edge panel flaps. The second edge panel may be connected to the second side edge and may have one or more edge slots. The front panel may be connected to the leading edge and may have a front panel insert. The bottom panel may be connected to the trailing edge and may have a bottom panel slot. The first edge panel may be configured to fold over the first side edge. The second edge panel may be configured to fold over the second side edge. The one or more first edge panel flaps may be configured to interlock with the one or more edge slots to form the enclosure. The front panel may be configured to fold over the leading edge. The bottom panel may be configured to fold over the trailing edge. The bottom panel slot may be configured to receive the front panel insert to interlock to form the enclosure.

In another aspect, the subject matter is embodied in an envelope for holding a cassette containing a blood bag. The multiple panels include a top panel, a first edge panel, a second edge panel, a front panel and a bottom panel. The multiple panels are configured to fold to form the enclosure to hold the cassette. The envelope includes a suspension device suspended from at least one panel of the multiple panels and is configured to suspend the cassette within the enclosure when the multiple panels are folded.

In another aspect, the subject matter is embodied in an apparatus for transporting a blood bag. The apparatus includes a cassette configured to receive the blood bag. The apparatus includes an envelope having multiple panels. The multiple panels include a top panel, a first edge panel, a second edge panel, a front panel and a bottom panel. The multiple panels are configured to form the enclosure to hold the blood bag. The envelope includes a first hanger connected to an inner surface of the top panel. The envelope includes a second hanger connected to an inner surface of the first edge panel. The envelope includes a suspension device suspended from the first hanger and the second hanger. The suspension device is configured to suspend the cassette within the enclosure when the multiple panels are folded to form the enclosure.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Disclosed herein are systems, apparatuses and devices for transporting and storing a blood bag. The system, apparatus or device may be a blood bag envelope ("envelope") that stores and transports the blood bag. Particular embodiments of the subject matter described in this specification may be implemented to realize one or more of the following advantages.

The envelope is made from a polymeric material that is able to withstand cryogenic temperatures. That is, the polymeric material is resistant to brittleness and not as susceptible to shattering at cryogenic temperatures. The envelope includes a suspension device or system that cradles the blood bag or the metal cassette that holds the blood bag. The suspension device absorbs any shocks to the envelope, and thus, protects the blood bag from vibrations, drops, impacts, or other shocks.

The suspension device may be configured and made from different materials, such as having shock absorbing leaf springs that cushion the impact of the blood bag within the envelope or a gel that remains pliable at cryogenic temperatures. The different configurations and materials assist in absorbing shock and/or vibrations. The suspension device may be configured as interlocking fingers that cradle the blood bag during transport within a metal container.

Other benefits and advantages include one or more protective shields that protect the suspension device. The suspension device may be a suspension netting that cradles the blood bag or metal cassette. The suspension netting may have one or more protective shields, such as a cassette holder, that protect the suspension cradle from any sharp edges of a metal cassette that holds the blood bag. The one or more protective shields protect the suspension netting from sharp edges that may damage, slice or otherwise cut through the suspension cradle.

Figure 1A:
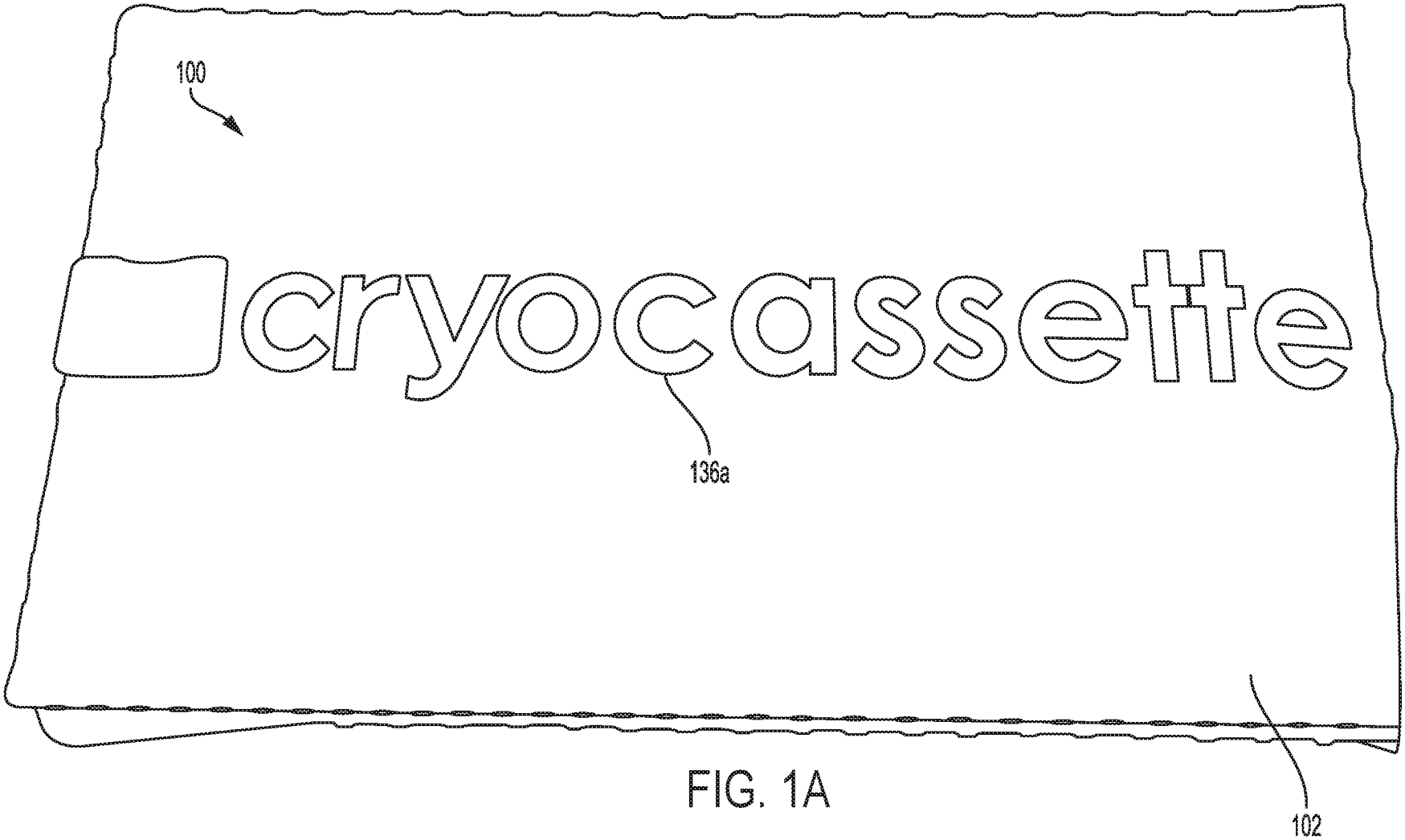
FIG. 1A is top perspective view of an example blood bag envelope according to an aspect of the invention.
Figure 1B:
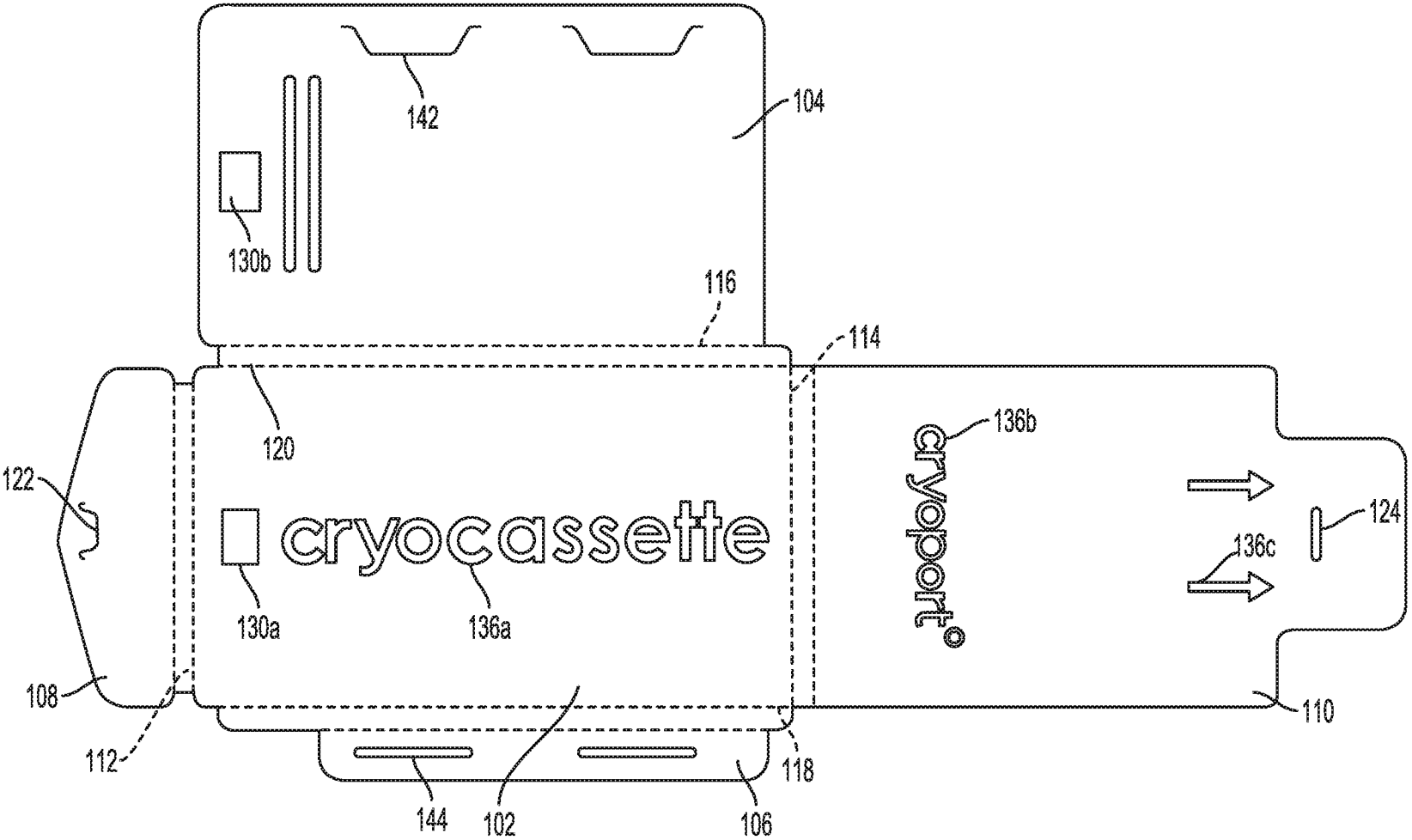
FIG. 1B is a schematic diagram of the top perspective view of the blood bag envelope of FIG. 1A unfolded according to an aspect of the invention.

FIG. 1A is a top perspective view of the blood bag envelope ("envelope") 100, and FIG. 1B is a top perspective view of the envelope 100 unfolded. The envelope holds a blood bag and protects the blood bag from shattering during transportation and/or storage of the blood bag. The envelope 100 may be made from a polymer material so that the envelope may withstand cryogenic temperatures without shattering or breaking. The envelope may hold, enclose and protect different sizes of blood bags, such as a 50-ml blood bag, a 250-ml blood bag, and/or a 500-ml blood bag. The envelope 100 has multiple panels that fold to enclose the blood bag 126 within. The envelope 100 has one or more fastening devices 132*a-b* and a suspension device 134 that suspends the blood bag 126 within the enclosure of the envelope 100. The envelope 100 may have one or more notches, tabs or hooks that connect or fasten to a fastening device of a dewar so that the envelope 100 may be hung within the dewar.

Figure 2:
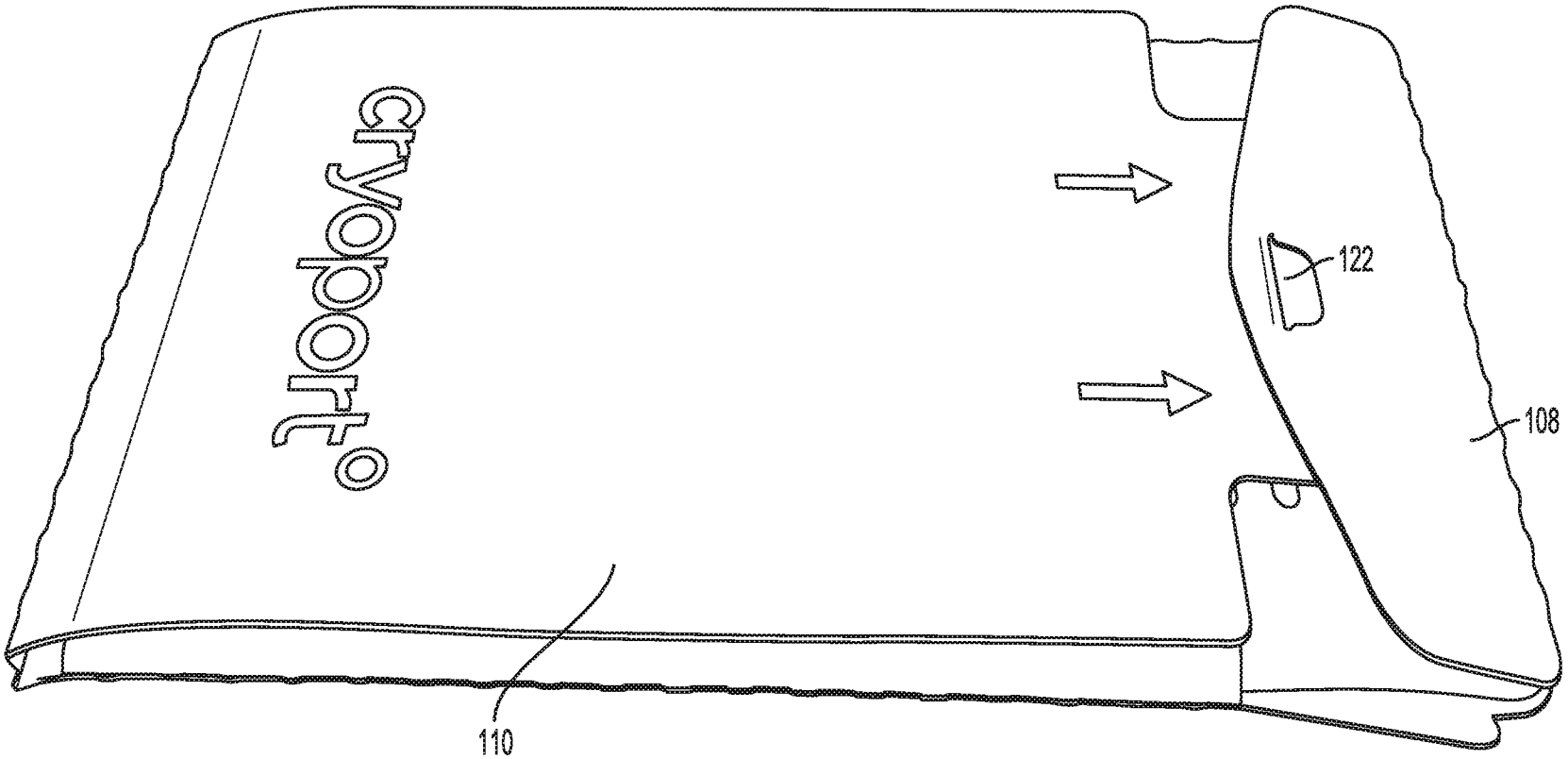
FIG. 2 is a bottom perspective view of the blood bag envelope of FIG. 1A according to an aspect of the invention.

The multiple panels include a top panel 102, a first edge panel 104, a second edge panel 106, a front panel 108 and a bottom panel 110, as shown in FIG. 1B for example. The multiple panels fold to form the enclosure that holds the blood bag 126 when the blood bag 126 is inserted. FIG. 2 is a bottom perspective view of the envelope 100 that shows the multiple panels are folded and the front panel insert 122 is inserted into the bottom panel slot 124 to close the envelope 100 and form the enclosure.

Figure 3A:
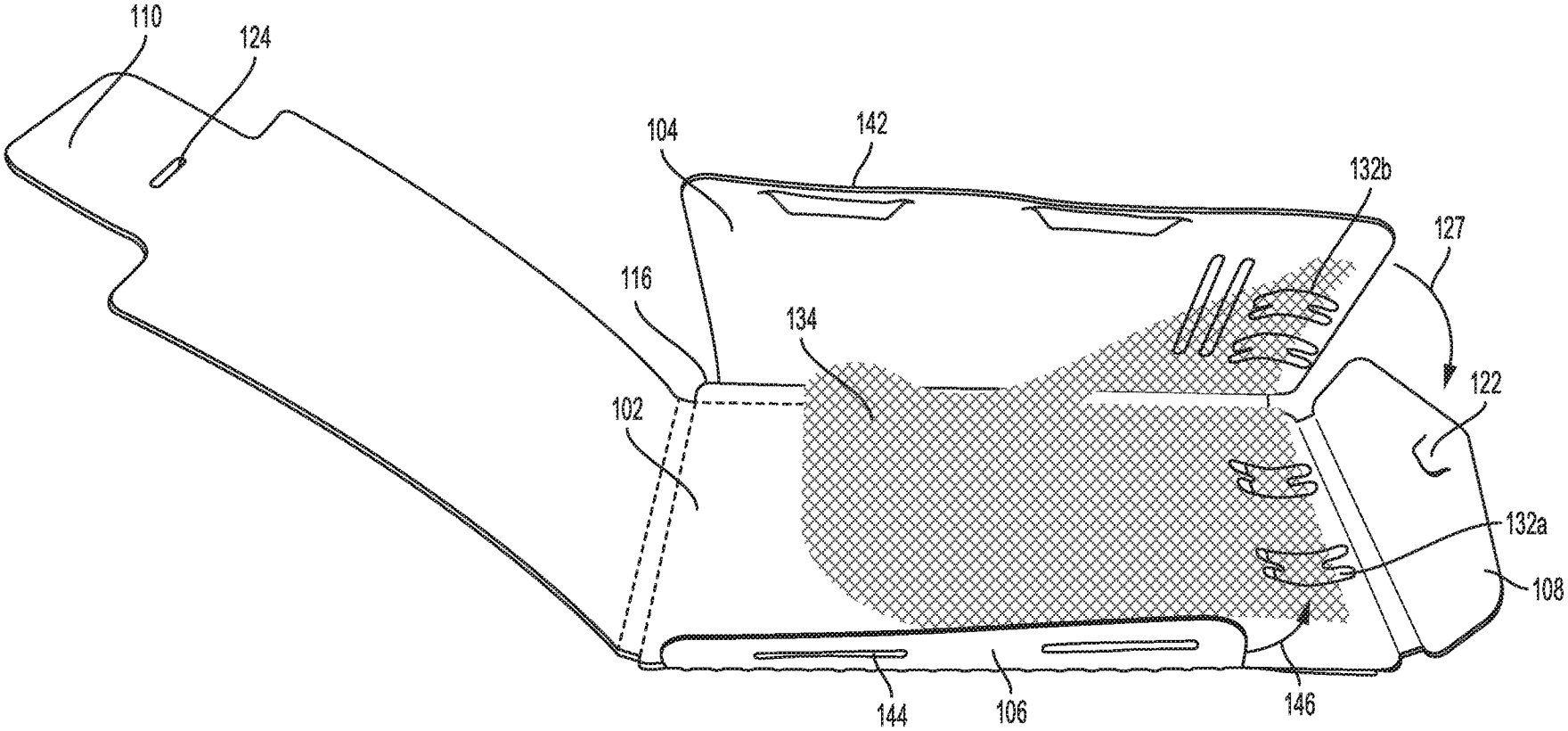
FIG. 3A is an exposed view of the blood bag envelope of FIG. 1A unfolded according to an aspect of the invention.
Figure 3B:
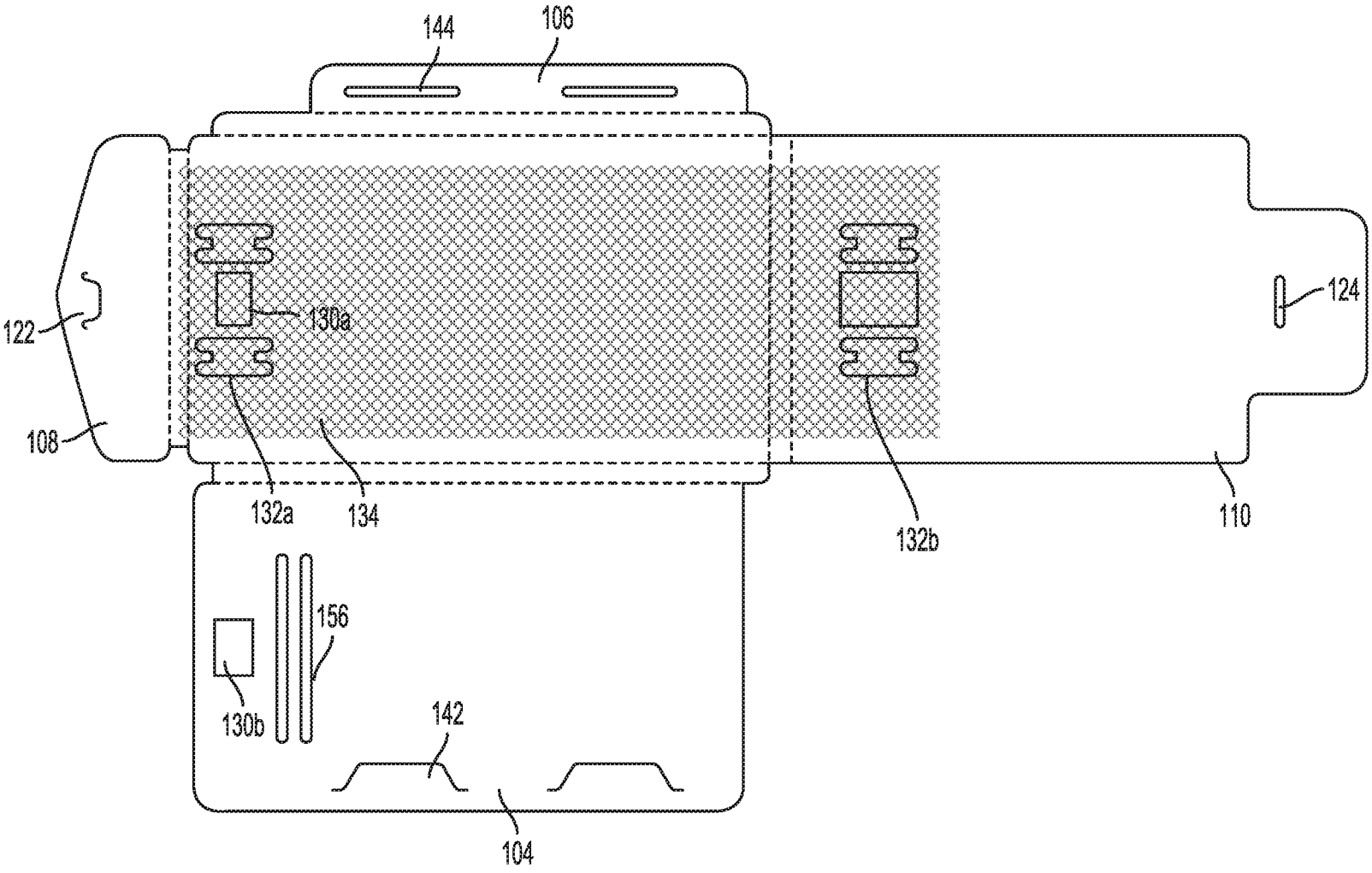
FIG. 3B is a schematic diagram of the exposed view of the blood bag envelope of FIG. 1A unfolded according to an aspect of the invention.
Figure 3C:
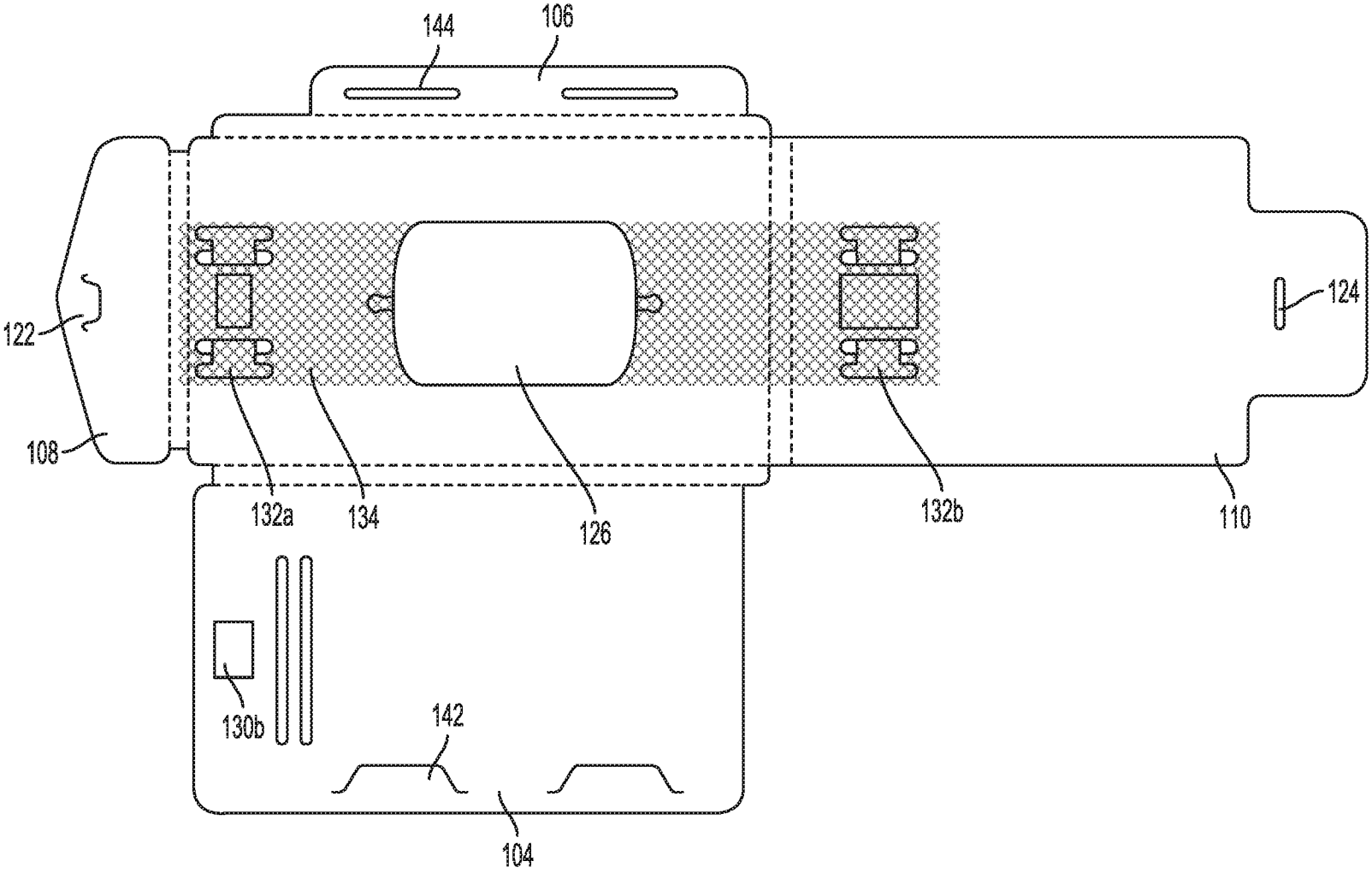
FIG. 3C is a schematic diagram of the exposed view of the blood bag envelope of FIG. 1A with a blood bag according to an aspect of the invention.

The envelope 100 has a top panel 102. The top panel 102 may have a slot 130*a*. One or more fastening devices 132*a-b*, such as a hanger or one or more fingers, may be inserted into the slot 130*a* and connect to and through the inner surface of the top panel 102, as shown in FIGS. 3A-3C for example. The top panel fastening device 132*a* may hold a suspension device 134 which suspends or holds the blood bag 126 in place while the blood bag 126 is within the enclosure of the envelope 100.

One or more marks or logos, such as the marks 136*a-c*, may be on the top panel 102 and/or the bottom panel 110. The one or more marks or logos may identify the envelope, contents of the envelope and/or shipper to provide notice to an individual handling, transporting and/or storing the envelope 100. The one or more marks, such as the arrows 136*c*, may identify the location of the opening where a blood bag 126 is to be inserted.

The top panel 102 has multiple edges. The multiple edges include a leading edge 112, a trailing edge 114, a first side edge 116 and a second side edge 118. The multiple edges connect the other panels of the multiple panels to the top panel 102 so that the other panels fold over to form the enclosure. The multiple edges may have one or more perforations 120 that facilitate the separation of the different panels and allow the different panels to fold over to form the enclosure, as shown in FIG. 1B for example. Each edge of the multiple edges may connect the top panel 102 to one of the other panels.

The envelope 100 has a first edge panel 104. The first edge panel 104 connects to the top panel 102 at the first side edge 116 and folds over the first side edge 116 to form part of the enclosure. The first edge panel 104 may fold over the first side edge 116 in the direction 127, as shown in FIG. 3A for example.

Figure 5:
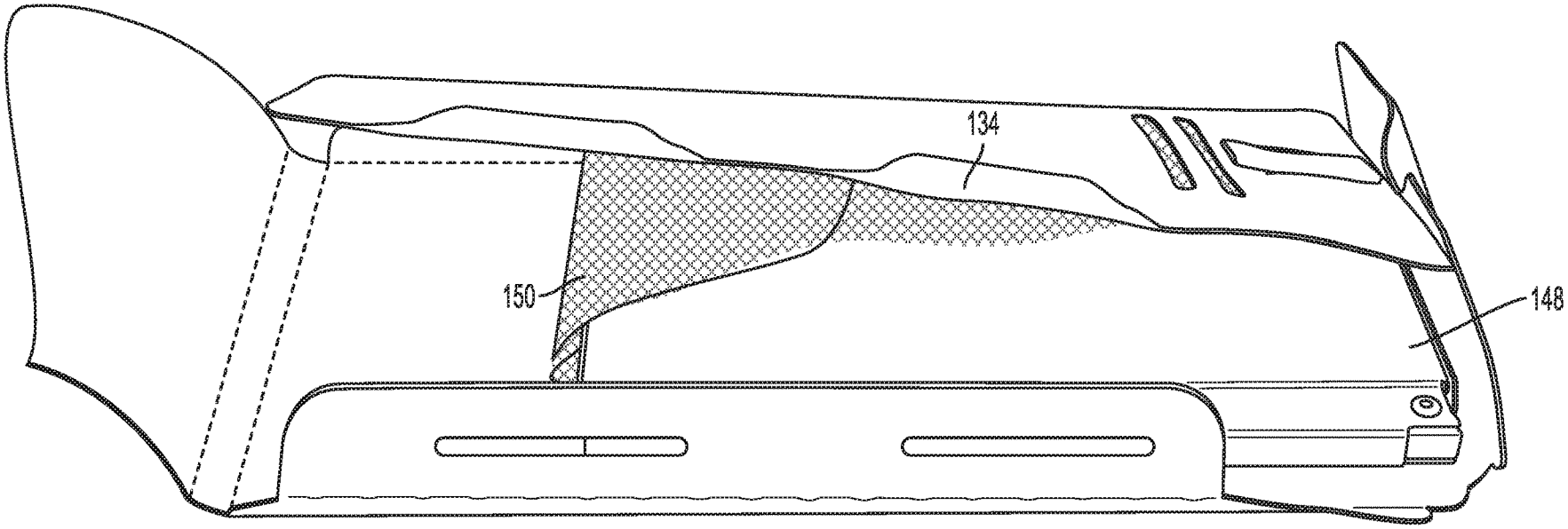
FIG. 5 is an exposed view of the blood bag envelope of FIG. 4 holding a cassette according to an aspect of the invention.

The first edge panel 104 may have one or more fasteners or inserts, such as the one or more first edge panel flaps 142. Other fasteners may include notches and/or clips. The one or more first edge panel flaps 142 may be inserted into one or more edge slots 144 of the second edge panel 106 when the first edge panel 104 is folded over the top panel 102 along the first side edge 116 to form the enclosure around the blood bag 126. In some implementations, the enclosure may surround or enclose a container or cassette, such as a metal cassette 148, which holds the blood bag 126, as shown in FIG. 5 for example.

The first edge panel 104 may have a slot 130*b*. One or more edge panel fastening devices 132*b*, such as a hanger, may be inserted into the slot 130*b* and connect to and through the inner surface of the first edge panel 104. The edge panel fastening device 132*b* may hold the suspension device 134 in place within the enclosure of the envelope 100. Both the edge panel and top panel fastening devices 132*a-b* may simultaneously hold the suspension device 134 in place. In some implementations, the one or more fastening devices 132*a-b* may be inserted into slots in different panels, such as the bottom panel 110, to hold the suspension device 134.

The first edge panel 104 may have one or more vents 156. The one or more vents 156 are openings and/or holes within the first edge panel 104. The one or more vents 156 may allow air to flow into a closed envelope 100 so that condensation does not build up within the enclosure of the envelope 100.

Figure 6:
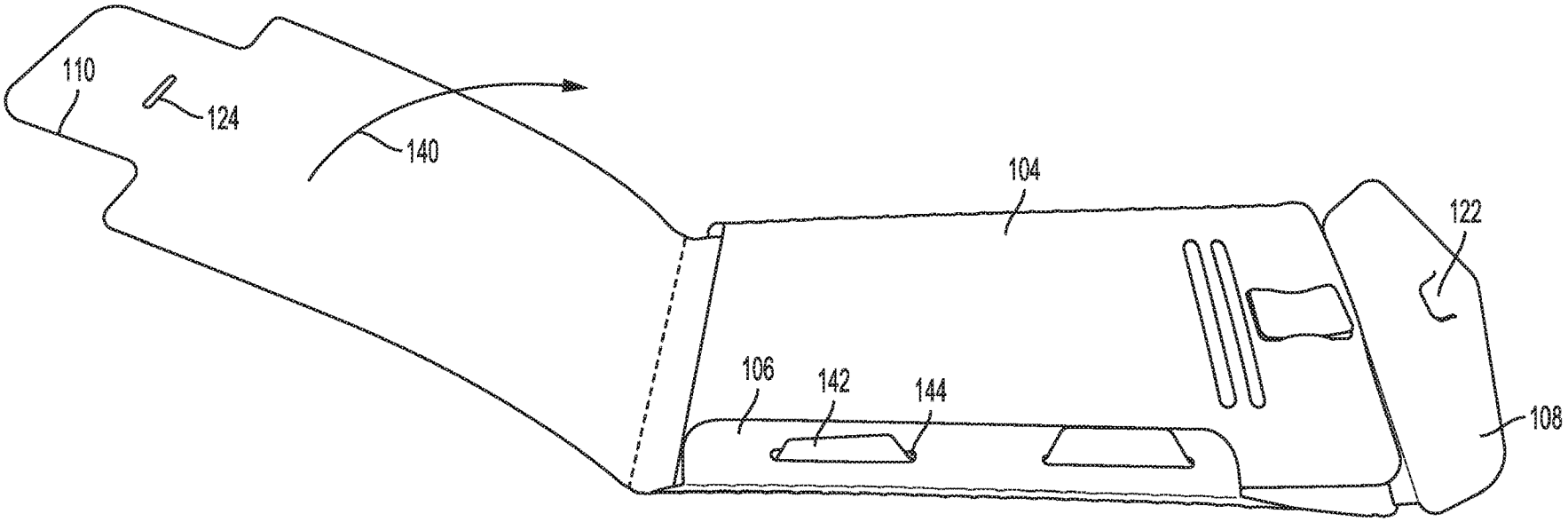
FIG. 6 is an exposed view of the blood bag envelope of FIG. 1A that is partially folded according to an aspect of the invention.

The envelope 100 includes a second edge panel 106. The second edge panel 106 is connected on the opposite side of the top panel 102 relative to the first edge panel 104 when the two panels 104, 106 are unfolded and face opposite the top panel 102 when folded inward in direction 146 over the second side edge 118, as shown in FIG. 3A for example. The second edge panel may have one or more edge slots 144. When the second edge panel 106 and the first edge panel 104 are folded inward, the one or more fasteners of the first edge panel 104, such as the one or more first edge panel flaps 142, may connect to the second edge panel 106, via the one or more edge slots 144, to form the enclosure. The one or more first edge panel flaps 142 may insert into the one or more edge slots 144 so that the first edge panel 104 and the second edge panel 106 interlock. The interlocked first edge panel 104 and second edge panel 106 are shown in FIG. 6, for example.

The envelope 100 includes a suspension device 134. FIGS. 3A-3C and FIG. 4 show the suspension device 134 within an unfolded envelope 100. The suspension device 134 may be made from a polymer, high-density polyethylene fiber, polypropylene, or other polymeric material, and may be formed as a fishnet, net or hammock that has a lattice framework that cradles the blood bag 126 or a container holding the blood bag 126. The polymeric material allows the suspension device 134 to remain pliable at or below cryogenic temperatures. Moreover, the suspension device 134 prevents the container or blood bag 126 from sliding and/or moving in place so that the blood bag 126 does not make contact with the inner surface of the envelope 100 or container when suspended. The suspension device 134 may be multiple interlocking fingers that cradle the blood bag 126 or the container. The container may be a cassette, such as the metal cassette 148. In some implementations, the suspension device 134 is a shock absorbing leaf spring that cushions any impact. In other implementations, the suspension device 134 is a gel that remains pliable at cryogenic temperatures. The suspension device 134 may absorb shock and reduce shock or vibration by as much as 50 Gs.

Figure 8:
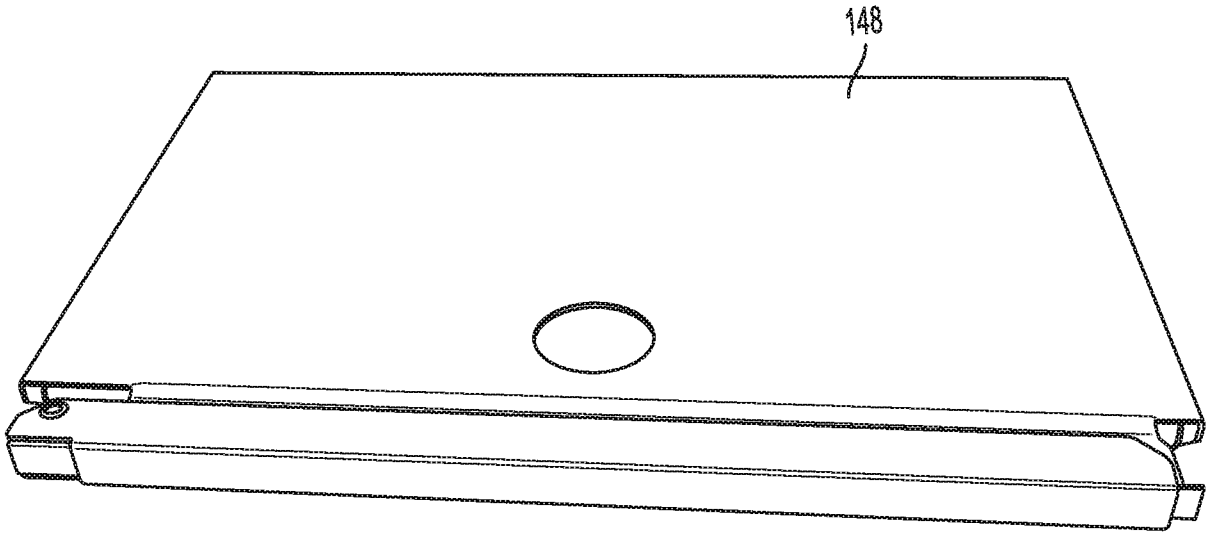
FIG. 8 is an example metal cassette that holds a blood bag and is inserted into the blood bag envelope of FIG. 1A according to an aspect of the invention.

The one or more fastening devices 132*a-b* connect to the panels and may hold or suspend the suspension device 134 within the enclosure. The suspension device 134 holds or suspends the blood bag 126 or the cassette within the enclosure to limit or reduce shocks, vibrations and/or impact to the blood bag 126 or the cassette. The one or more fastening devices 132*a-b* may allow the blood bag 126 or the cassette to bounce or otherwise move to absorb shock and/or vibrations. The cassette may be a metal cassette 148, as shown in FIG. 8 for example, which may contain the blood bag 126.

Figure 4:
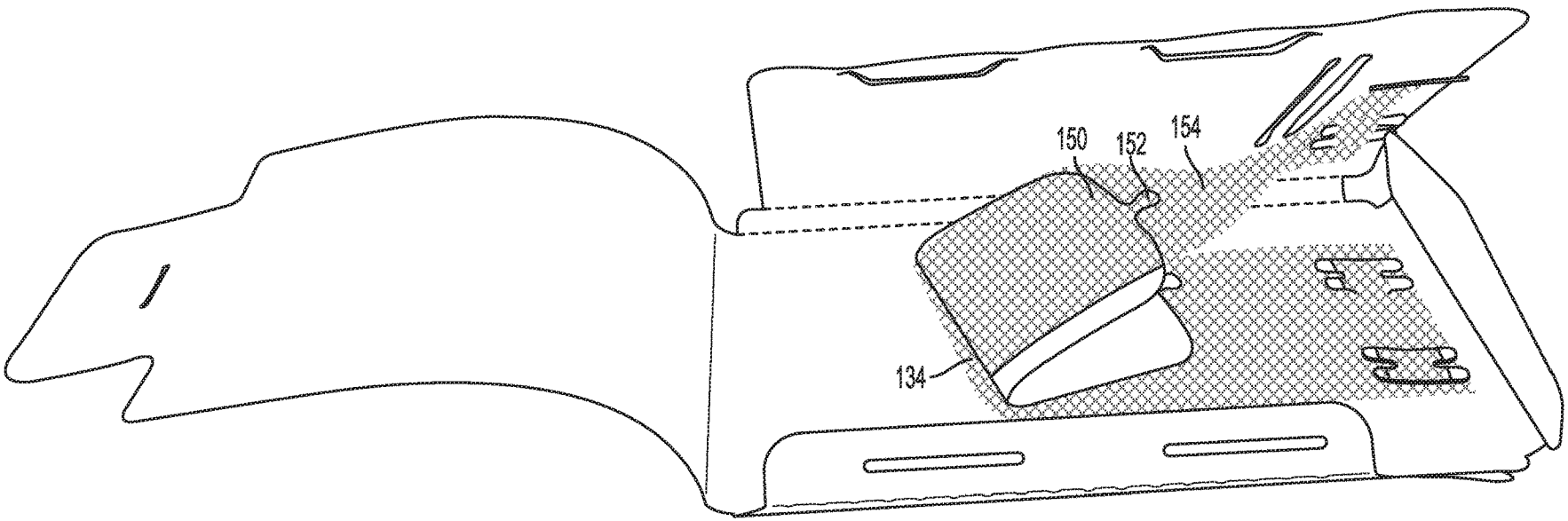
FIG. 4 is an exposed view of the blood bag envelope of FIG. 1A unfolded and having a cassette holder according to an aspect of the invention.

The suspension device 134 may have a protective shield, such as the cassette holder 150. The cassette holder 150 may be made from a polymer and may be connected to the suspension device 134. The cassette holder 150 may hold the metal cassette 148 or any other encasement or container that encloses the blood bag 126 within the suspension device 134. The cassette holder 150 acts as a protective shield that prevents sharp edges or corners of the cassette from damaging or tearing the suspension device 134. The cassette holder may have an elliptical or oval shaped insert 152 that is inserted into a cell or opening 154 of the lattice framework of the suspension device 134, as shown in FIG. 4 for example.

The envelope 100 includes the bottom panel 110. The bottom panel 110 has a bottom panel slot 124 and connects to the top panel 102 at the trailing edge 114. The bottom panel 110 is on the opposite side of the top panel 102 relative to the front panel 108 when unfolded and faces opposite the top panel 102 when folded inward over the trailing edge 114. The bottom panel 110 folds over the trailing edge 114, e.g., in direction 140, to interconnect with the front panel 108 when the front panel 108 is in the closed position, as shown in FIG. 6 for example. In the closed position, the front panel insert 122 is interlocked with or inserted into the bottom panel slot 124 to secure the front panel 108 over a portion of the bottom panel 110.

The envelope 100 has a front panel 108. The front panel 108 connects to the top panel 102 along the leading edge 112. The front panel 108 folds inward along the leading edge 112. The front panel 108 may be in an open or closed position. When the front panel 108 is in the open position, a blood bag 126 may be inserted into a recess 128 formed by the enclosure by the multiple panels. The front panel 108 may be placed into the closed position to fully enclose the blood bag 126 after insertion of the blood bag 126.

Figure 7:
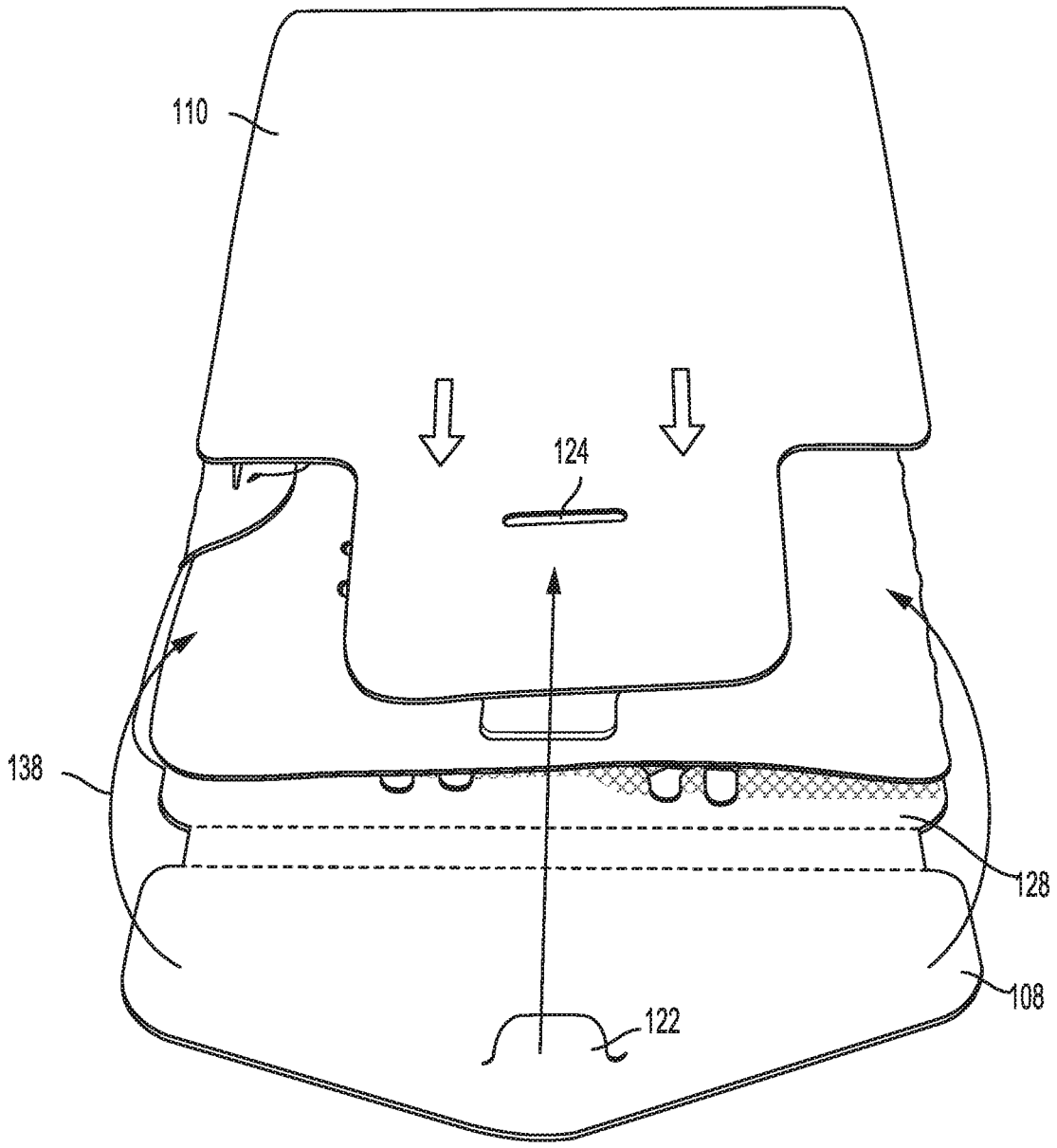
FIG. 7 is a front perspective view of the blood bag envelope of FIG. 1A according to an aspect of the invention.

The front panel 108 may have a front panel insert 122. The front panel insert 122 may be a flap or latch that is cutout of the front panel 108. The front panel 108 may be folded along the leading edge 112, e.g., in the direction 138, where the front panel insert 122 is inserted, interlocked or otherwise connected to a bottom panel slot 124 of the bottom panel 110 to close the envelope 100, as shown in FIG. 7 for example.

When the front panel 108 is in the open position, e.g., when the front panel insert 122 is not interlocked with the bottom panel slot 124, the envelope 100 may have a recess 128 that is formed by the top panel, bottom panel, the first edge panel, and the second edge panel. The metal cassette 148 and/or the blood bag 126 may be inserted into the envelope 100 via the recess 128, and the front panel 108 may be closed to protect, transport and/or store the metal cassette 148 and/or the blood bag 126. When the front panel 108 is in the closed position, e.g., when the front panel insert 122 is interlocked with the bottom panel slot 124, the envelope 100 forms the enclosure around the blood bag 126 or cassette placed inside the envelope 100.

FIG. 8 shows the metal cassette 148. The envelope 100 may interchangeably hold and/or enclose the blood bag 126 with or without the metal cassette 148 surrounding the blood bag 126. In some implementations, the envelope 100 may accommodate, enclose and protect the blood bag 126 with a surrounding overlap bag and/or metal cassette 148.

Figure 9:
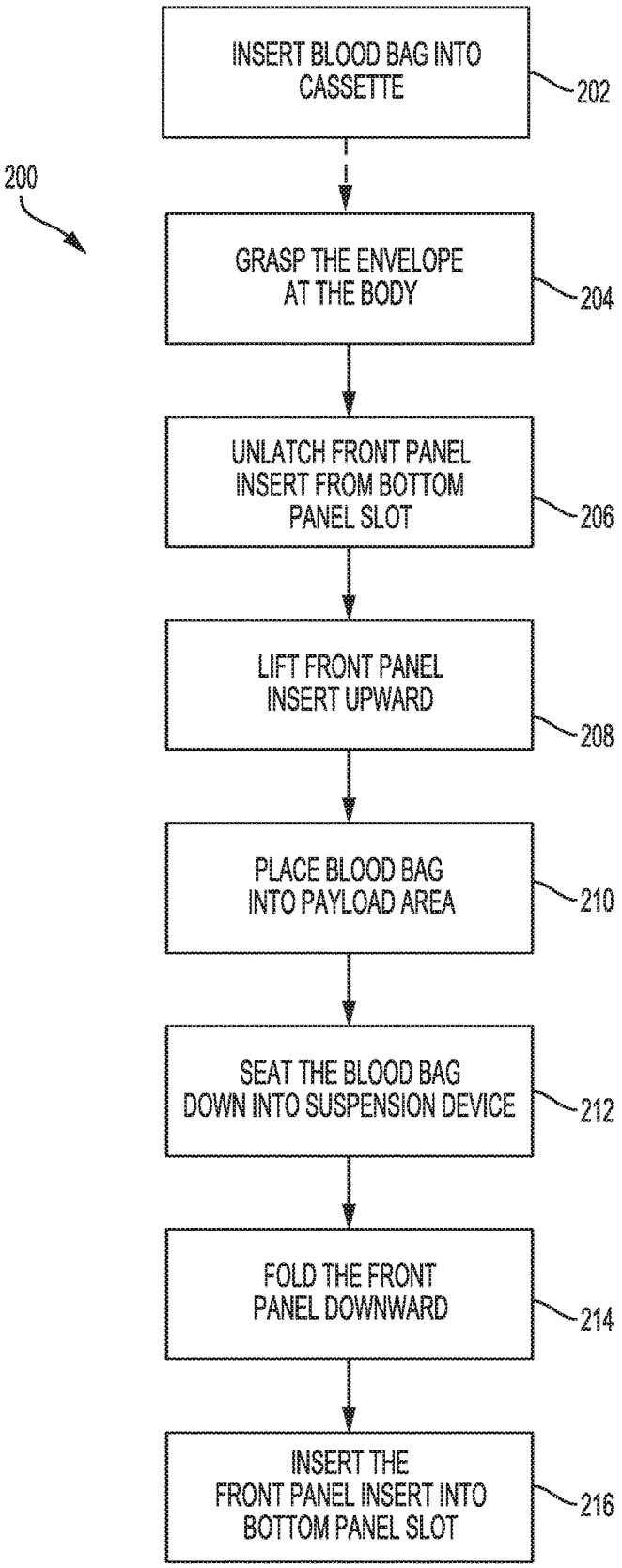
FIG. 9 is an example process for inserting the metal cassette of FIG. 8 into the blood bag envelope of FIG. 1A according to an aspect of the invention.

FIG. 9 is a process for inserting or loading the blood bag 126 into the blood bag envelope 100. A user, such as a medical professional or technician, that is preparing the blood bag 126 for storage and/or transport may insert the blood bag 126 into a cassette, such as the metal cassette 148 (202). The blood bag 126 may be surrounded by an overwrap bag that prevents leakage of blood from the blood bag 126 if the blood bag 126 is punctured. The blood bag 126 and/or the overwrap bag may be placed into the cassette prior to insertion into the envelope 100.

The user grasps the envelope 100 at the body of the envelope 100 (204). The body of the envelope 100 consists of the top panel 102 and the bottom panel 110. The user may firmly grip the body of the envelope 100 between the top panel 102 and the bottom panel 110, for example.

Next, if the front panel insert 122 is inserted into and/or interlocked with the bottom panel slot 124, the user unlatches the front panel insert 122 from the bottom panel slot 124 to open the enclosure formed by the multiple panels of the envelope 100 (206). With the front panel insert 122 unlatched from the bottom panel slot 124, the user lifts the front panel insert 122 or front panel 108 upward to open or partially open the envelope 100. This allows the user to insert the cassette or the blood bag 126 into the recess 128. The user places the cassette or the blood bag 126 via the recess 128 into the payload area and/or the cassette holder 150(210). The user seats the cassette or the blood bag 126 firmly within the suspension device 134 (212).

When the blood bag 126 or cassette is firmly seated within the suspension device 134 and/or the cassette holder 150, the user folds the front panel 108 downward so that the front panel 108 overlaps a portion of the bottom panel 110 (214). The user inserts or interlocks the front panel insert 122 with the bottom panel slot 124 to close the envelope 100 and enclose the blood bag 126 or cassette within the envelope 100 (216).

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An envelope for holding a blood bag, comprising:

a plurality of panels including a top panel, a first edge panel with an edge panel flap, a second edge panel with an edge slot, a front panel with a front panel insert and a bottom panel with a bottom panel slot, the edge panel flap being configured to couple with the edge slot when the first edge panel is folded over the top panel and the front panel insert being configured to couple with the bottom panel slot when the front panel is folded over the top panel to form an enclosure to hold the blood bag;

a first connector connected to an inner surface of the top panel; and a suspension device suspended from the first connector and configured to suspend the blood bag within the enclosure.

2. The envelope of claim 1, further comprising a second connector connected to an inner surface of the first edge panel, wherein the first connector is a first hanger and the second connector is a second hanger, wherein the suspension device is suspended from the first hanger and the second hanger.

3. The envelope of claim 2, wherein the first hanger is inserted into a slot in the top panel to suspend the blood bag within the enclosure.

4. The envelope of claim 3, wherein the second hanger is inserted into a slot in the first edge panel to suspend the blood bag within the enclosure.

5. The envelope of claim 1, wherein the suspension device is made from a polymer material.

6. The envelope of claim 1, wherein:

the top panel has a leading edge, a trailing edge, a first side edge, and a second side edge;

the first edge panel is connected to the first side edge;

the second edge panel is connected to the second side edge;

the front panel is connected to the leading edge; and the bottom panel is connected to the trailing edge.

7. The envelope of claim 6, wherein:

the first edge panel is configured to fold over the top panel along the first side edge;

the second edge panel is configured to fold over the top panel along the second side edge, the edge panel flap being configured to interlock with the edge slot to form the enclosure;

the front panel is configured to fold over the top panel along the leading edge; and the bottom panel is configured to fold over the top panel along the trailing edge, the bottom panel slot being configured to receive the front panel insert to form the enclosure.

8. The envelope of claim 1, further comprising:

a second connector connected to an inner surface of the first edge panel, wherein the suspension device is a polymer lattice and is suspended from the first connector and the second connector and is configured to receive a metal cassette that holds the blood bag.

9. An envelope for holding a cassette containing a blood bag, comprising:

a plurality of panels including a top panel, a first edge panel with an edge panel flap, a second edge panel with an edge slot, a front panel with a front panel insert and a bottom panel with a bottom panel slot, the edge panel flap being configured to couple with the edge slot when the first edge panel is folded over the top panel and the front panel insert being configured to couple with the bottom panel slot when the front panel is folded over the top panel to form an enclosure to hold the cassette; and a suspension device suspended from at least one panel of the plurality of panels and configured to suspend the cassette within the enclosure.

10. The envelope of claim 9, wherein the suspension device is suspended from an inner surface of the top panel.

11. The envelope of claim 10, wherein the suspension device is further suspended from an inner surface of the first edge panel.

12. The envelope of claim 9, wherein the suspension device is a lattice polymer netting.

13. The envelope of claim 9, further comprising:

a first hanger connected to an inner surface of the top panel;

a second hanger connected to an inner surface of the first edge panel;

wherein the first hanger and the second hanger are configured to hold the suspension device.

14. An apparatus for transporting a blood bag, comprising:

a cassette configured to receive the blood bag; and an envelope having:

a plurality of panels including a top panel, a first edge panel with an edge panel flap, a second edge panel with an edge slot, a front panel with a front panel insert and a bottom panel with a bottom panel slot, the edge panel flap being configured to couple with the edge slot when the first edge panel is folded over the top panel and the front panel insert being configured to couple with the bottom panel slot when the front panel is folded over the top panel to form an enclosure to hold the blood bag;

a first hanger connected to an inner surface of the top panel;

a second hanger connected to an inner surface of the first edge panel; and a suspension device suspended from the first hanger and the second hanger, the suspension device being configured to suspend the cassette within the enclosure.

15. The apparatus of claim 14, wherein the envelope is made of a polymer and the suspension device is a lattice polymer netting.

16. The apparatus of claim 14, wherein:

the top panel has a leading edge, a trailing edge, a first side edge, and a second side edge;

the first edge panel is connected to the first side edge;

the second edge panel is connected to the second side edge;

the front panel is connected to the leading edge; and the bottom panel is connected to the trailing edge.

17. The apparatus of claim 16, wherein:

the first edge panel is configured to fold over the top panel along the first side edge;

the second edge panel is configured to fold over the top panel along the second side edge, the edge panel flap being configured to interlock with the edge slot to form the enclosure;

the front panel is configured to fold over the top panel along the leading edge; and the bottom panel is configured to fold over the top panel along the trailing edge, the bottom panel slot being configured to receive the front panel insert to form the enclosure.

18. The apparatus of claim 14, wherein the first hanger is inserted into a slot in the top panel.

19. The apparatus of claim 18, wherein the second hanger is inserted into a slot in the first edge panel.

20. The apparatus of claim 14, wherein the cassette is a metal cassette.

* * * * *